US006188327B1

(12) United States Patent
Cousins et al.

(10) Patent No.: US 6,188,327 B1
(45) Date of Patent: Feb. 13, 2001

(54) SUBSEA ELECTRONIC TAGGING AND MONITORING SYSTEMS

(75) Inventors: Anthony R. Cousins, London; Timothy M. Lower, Wokingham, both of (GB)

(73) Assignee: Mentor Subsea Technology Services, Inc., New Orleans, LA (US)

( * ) Notice: Under 35 U.S.C. 154(b), the term of this patent shall be extended for 0 days.

(21) Appl. No.: 09/356,918

(22) Filed: Jul. 19, 1999

(51) Int. Cl.[7] ..... G01V 3/00

(52) U.S. Cl. ..... 340/853.9; 340/853.1; 340/854.1

(58) Field of Search ..... 430/572.1, 568.1, 430/568.8, 853.1, 853.2, 853.3, 853.9, 854.1, 854.2; 405/188, 170, 169, 193; 166/335, 343, 356, 368

(56) References Cited

U.S. PATENT DOCUMENTS

| | | | | |
|---|---|---|---|---|
| 4,117,688 | * | 10/1978 | Ball | 405/193 |
| 5,166,677 | * | 11/1992 | Schoenberg | 340/853.3 |
| 5,992,526 | * | 11/1999 | Cunningham et al. | 166/343 |
| 6,024,514 | * | 2/2000 | Ostergaard | 405/170 |

* cited by examiner

*Primary Examiner*—Van T. Trieu
(74) *Attorney, Agent, or Firm*—Robert J. Edwards

(57) ABSTRACT

A system for tagging and monitoring subsea installations such as valves used in hydrocarbon production includes a torque tool provided with a read/write head for inductive interaction with a data storage capsule on a valve installation, the capsule storing valve identification and status data. When the torque tool is operatively engaged with the shaft (or an adaptor) of the valve, the read/write head inductively energizes the capsule and inductively receives identification data from the capsule, as well as operating data of previous operation, and this data is sent to a console in an ROV so as to ensure correct identification of the valve and proper subsequent operation by the tool.

12 Claims, 3 Drawing Sheets

SUBSEA ELECTRONIC TAGGING AND MONITORING SYSTEMS

BACKGROUND OF THE INVENTION

1. Field of the Invention

This invention relates to electronic tagging and monitoring systems for subsea use, for example in tagging and monitoring of valves used in subsea pipelines and installations such as trees and manifolds for hydrocarbon production.

2. General Background

The accurate logging of subsea installed devices, such as the positions of valves in subsea trees and manifolds, has in many circumstances been difficult to achieve, particularly with frequent functioning-during installation and commissioning when many different parties may be involved.

The risks associated with not knowing the status of an installed device such as a valve prior to intervention (for example due to incomplete record keeping) are considerable. The valve assembly may sustain damage due to inappropriate torque being applied, or the operator believing that the valve is not functioning correctly if the valve does not move in the expected direction. At the very least, re-establishing the valve status by functioning is a time consuming exercise.

Another problem is positive valve identification, particularly where the marking system has deteriorated, or been damaged, possibly leading to inadvertent operation of the wrong valve.

In general, particularly in deep water, the operation/override of installed devices such as subsea valves is an activity undertaken by ROVs (Remotely Operated Vehicles), and the tools specified are largely similar in design. For valve operation, the torque tool is positioned in the valve interface/receptacle using a manipulator arm or a tool deployment mechanism mounted on the front of the ROV. When the tool is docked, it is located in the receptacle in the valve panel or on the valve. The valve stem has a profile/interface appropriate for the selected tool. When the torque tool is energized, the valve stem is turned and the reaction torque is reacted through the tool to the valve/panel interface, in other words the torque is reacted locally and not through the ROV. The tool basically comprises a hydraulic motor and gearbox with an appropriate drive interface. The problems with the existing arrangements are basically those set out above, resulting from difficulties in arriving at reliable valve (and valve type) identification, and also maintaining an effective log of past valve performance, including previous torque settings.

SUMMARY OF THE INVENTION

The present invention provides a subsea electronic tagging and monitoring system comprising a subsea installed device including a data storage capsule having tagging and operational data, and apparatus for operatively interacting with the subsea installed device, the apparatus comprising a read/write head for communication with the data storage capsule when the apparatus is positioned for operative interaction with the installed device, the apparatus including means for sending the operational data to data processing equipment.

The systems as described below are retro-fit applications for existing installations. In new build applications, the data storage capsule and the required interface would be incorporated in the original equipment.

In a preferred embodiment of the invention, to be described in greater detail below, there is provided a system for tagging and monitoring subsea installations such as valves used in hydrocarbon production, the system including a torque tool provided with a read/write head for inductive interaction with a capsule on a valve installation, the capsule storing valve identification and status data. When the torque tool is operatively engaged with the shaft (or an adaptor) of the valve, the read/write head inductively energizes the capsule and inductively receives identification data from the capsule, as well as operating data of previous operation, and this data is sent to a console in an ROV so as to ensure correct identification of the valve and proper subsequent operation by the tool.

BRIEF DESCRIPTION OF THE DRAWINGS

The present invention will now be described by way of example with reference to the accompanying drawings, throughout which like parts are referred to by like references, and in which.

DETAILED DESCRIPTION OF THE PREFERRED EMBODIMENT

Figure 1:
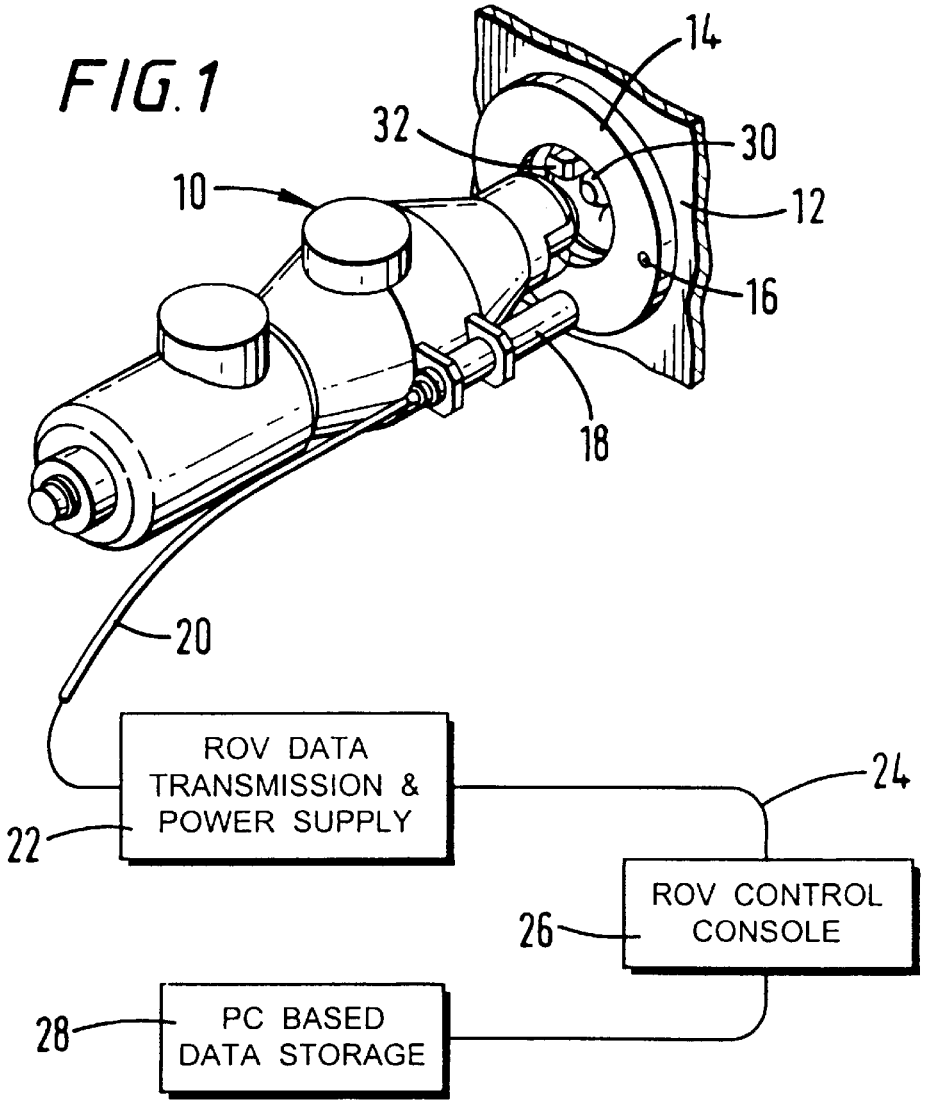
FIG. 1 is a perspective view of a system according to one embodiment of the invention.
Figure 2:
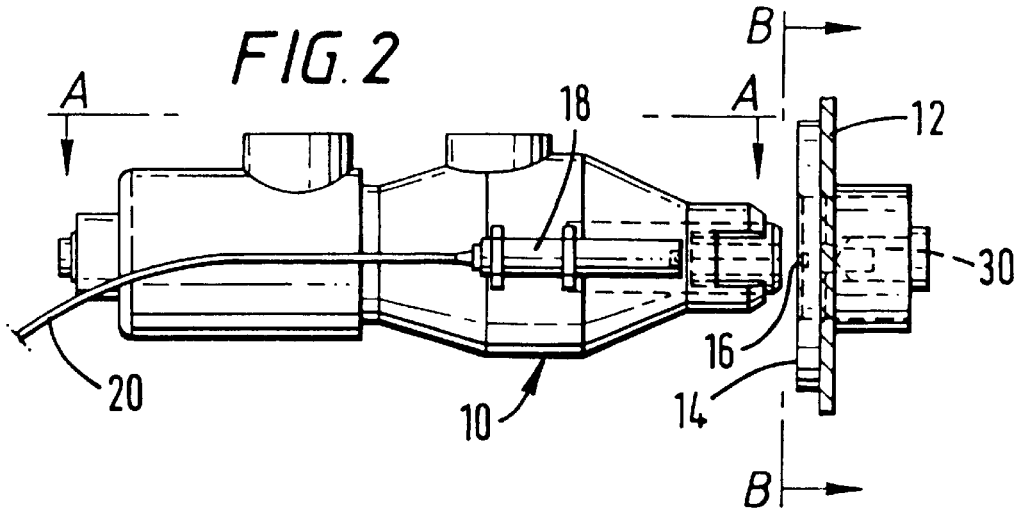
FIG. 2 is a side view of the tool shown in FIG. 1.
Figure 3:
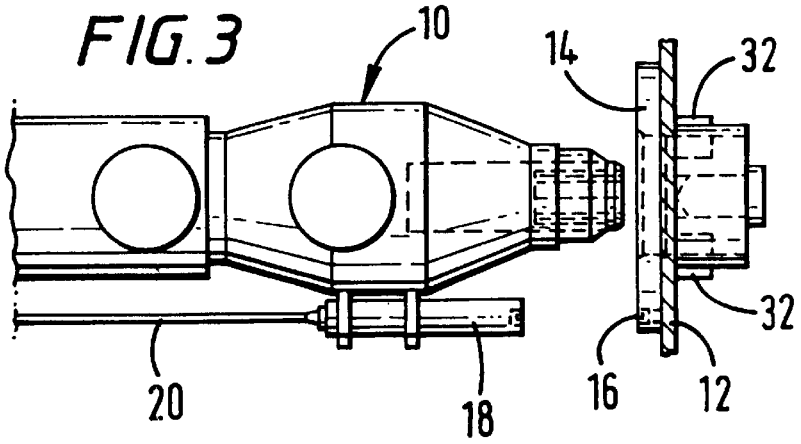
FIG. 3 is a view taken along lines A—A in FIG. 2.
Figure 4:
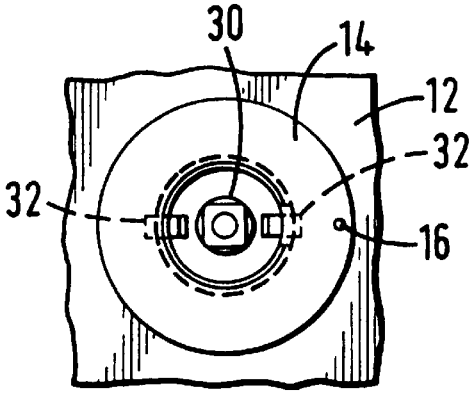
FIG. 4 is a view taken along lines B—B in FIG. 2.
Figure 8:
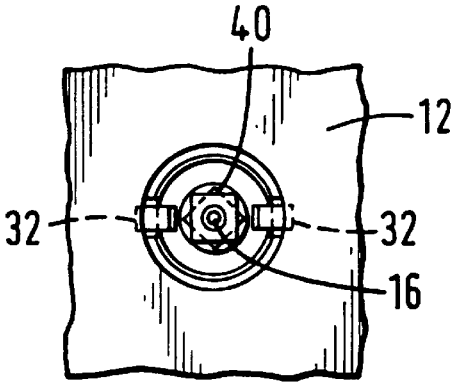
FIG. 8 is a view taken along lines B—B in FIG. 5.

Referring initially to FIGS. 1–4 of the drawings, there is shown a subsea valve electronic tagging and monitoring device according to one embodiment. An adapted valve torque tool 10 is shown adjacent a valve installation 12. The valve installation 12 either includes a valve shaft cap for retrofitting to an existing valve, in order to allow the operational profile of the torque tool 10 to fit and be able to turn the valve shaft, or the required profile can be machined on the valve shaft. As shown, the installation 12 includes an adaptor collar 14 provided with a data storage capsule 16. In a new build, the capsule 16 would be integral with the valve panel or tool receptacle. A read/write/head 18 is fitted to the torque tool 10 in such a way as to be positioned adjacent the capsule 16 when the torque tool 10 is operatively positioned to operate the valve in the installation 12. The torque tool 10 may be positioned by an ROV (not shown), as discussed above, by means of a manipulator arm or a tool deployment mechanism typically attached to the front of the ROV.

A cable 20 leads from/to the read/write head 18, and connects to an ROV data transmission and power supply 22 provided within the ROV. An ROV umbilical 24 leads from the ROV to an ROV control console 26 which is itself connected to a PC based data storage system 28.

As shown, the valve shaft 30 is profiled to fit the operating shaft of the torque tool 10, and non-rotatable profiles 32 are provided on the valve for engagement with corresponding non-rotatable profiles on the housing of the tool 10 so as to prevent reactive rotation of the tool 10 during torquing.

The data storage capsule 16 has generally-known construction, used for example in passive tagging security systems or in equipment tracking systems. The capsule preferably has no dedicated internal power supply, but instead receives its power by inductive coupling with the read/write head 18 which receives power from the supply 22 in the ROV. Data transfer between the capsule 16 and the read/write head is then preferably also achieved by means of inductive coupling. The data storage capsule 16 is preferably potted in epoxy, which makes it suitable for subsea applications.

The adaptor collar 14 provides a unique interface preventing operation by unauthorised tools, thereby ensuring that data is logged during each operation. Thus the arrangement shown in FIGS. 1–4 can be achieved as a result of modifying a standard torque tool by attaching the read/write head 18 to the side of the tool 10. When the tool is engaged, the read/write head 18 contacts the data capsule 16 on the modified valve installation adaptor collar 14 (or, in a new build, on some part of the valve structure such as the valve panel or tool receptacle). This requires minimal modification to the existing tool.

An alternative arrangement is shown in FIGS. 5–8. This is broadly similar to that described earlier in connection with FIGS. 1–4, except that the data storage capsule 16 is mounted directly on a valve adaptor spindle 40. Alternatively, the capsule 16 could be mounted directly on the valve spindle for a new build valve.

Figure 7:
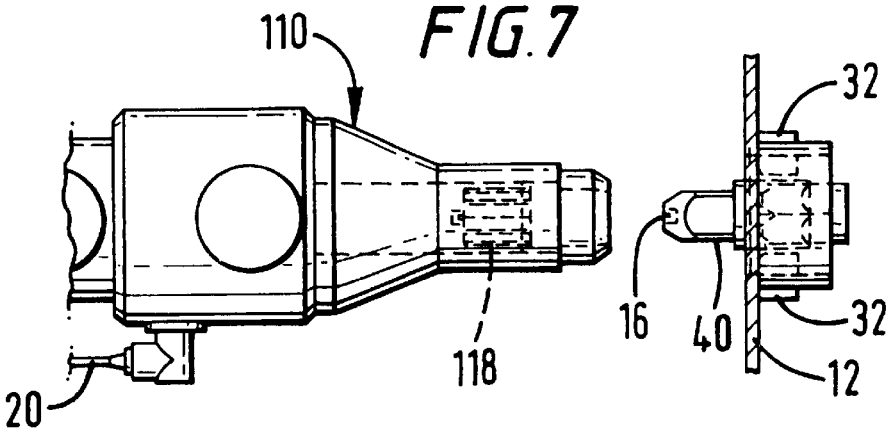
FIG. 7 is a view taken along lines A—A in FIG. 5.
Figure 5:
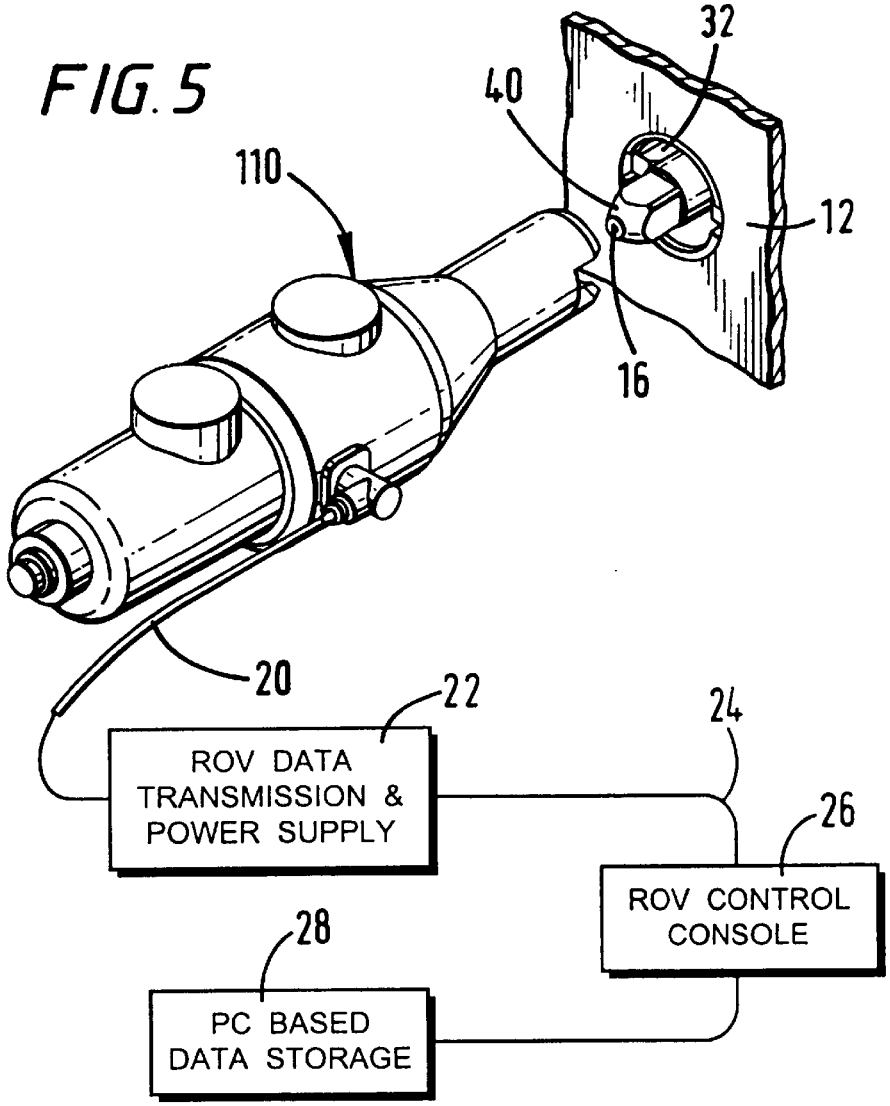
FIG. 5 is a perspective view of a system according to another embodiment of the invention.
Figure 6:
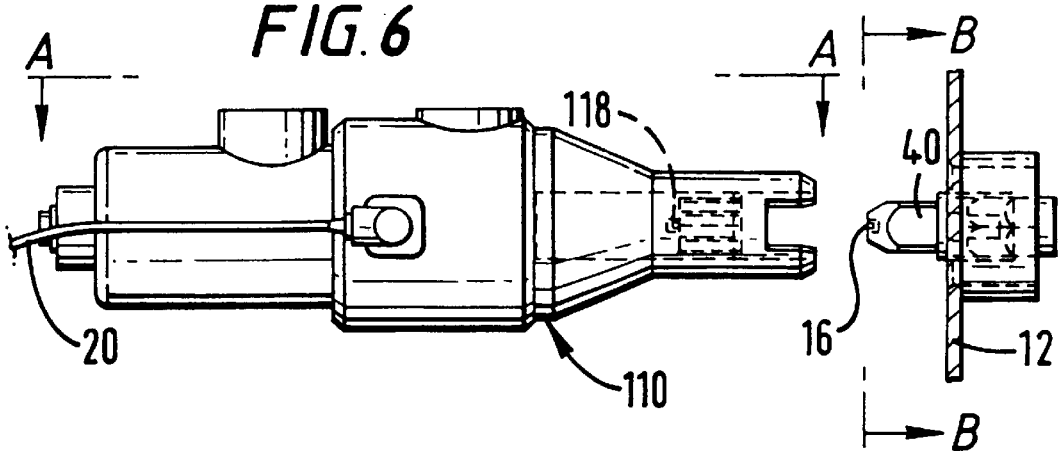
FIG. 6 is side view of the tool shown in FIG. 5.

The read/write head 118 is then installed within the torquing part of the torque tool 110, as can be seen in FIGS. 6 and 7. This arrangement may require redesign of the torque tool to accommodate the head 118, and also some means such as a slip-ring arrangement may be required in order to allow electrical signals to be transmitted from the rotatable drive head to the stationary tool body.

When a valve shaft cap is fitted to an existing valve shaft, the cap provides a unique interface preventing operation by unauthorised tools, thereby ensuring that data is logged during each operation.

In operation of either arrangement, the tool 10 (or 110) is brought up to the valve installation 12, and once the tool is locked on to the valve spindle or adaptor, the data storage capsule 16 will be powered up inductively from the read/write head. It is then possible for the capsule 16 to provide identification data which is sent via the ROV data transmission and power supply 22 to the ROV control console 26. Once the valve has been identified, data can be displayed by the console 26, and also valve history information may be obtained from the capsule 16 and/or the data storage 28. The data processing software is preferably compatible with Windows (TM) and may enable the data to be stored locally for subsequent transfer to rig computer or central storage. The software also preferably permits automatic generation and update of valve status records, and provides valve performance details.

It will therefore be apparent that the system allows positive valve identification, thereby overcoming the problems of marking systems having deteriorated or been damaged. Vital valve operation can therefore be stored and retrieved locally in a simple and accurate manner, thus preventing incorrect operation. Accordingly, the system has the significant potential to reduce the risks associated with valve identification and proper knowledge of current valve position (status) during operation. The system also has the capacity to record historical data to enable performance monitoring which may give an early indication of degradation.

It is possible that, in shallower waters, the system could be adapted for use by a diver, rather than an ROV. In that case, the tool would be made self-contained and carry a power supply such as a battery, data storage and a display in addition to the read/write head. Also, an integral torque measuring device and a turn counter should be incorporated. The data stored during operation of the tool would then be downloaded to a PC when the diver and tool return to the surface.

Other subsea intervention operations such as those undertaken by an ROV can adopt similar techniques. The positioning of the data capsule adjacent other intervention points would provide identification and operational information in the same manner as for the above-described valve operation. These locations may include (but not be limited to):

hydraulic and electrical "hot-stabs";
umbilical stab-plates;
ROV docking points;
tooling interfaces;
lifting points,
guideposts;
choke override interfaces;
subsea control modules;
and any other device that would benefit from having a locally-stored operational history.

Many varying and differing embodiments may be within the scope of the inventive concept herein taught and because many modifications may be made to the arrangements herein described, it is to be understood that the details here described are to be interpreted as illustrative and not in a limiting sense.

What is claimed is:

1. A subsea electronic tagging and monitoring system comprising:

a subsea installed device including a data storage capsule having tagging and operational data; and apparatus for operatively interacting with the subsea installed device, the apparatus comprising a read/write head for communicating with the data storage capsule, the read/write head being disposed so as to communicate with the data storage capsule when the apparatus is positioned for operative interaction with the installed device, the apparatus including means for sending the operational data to data processing equipment.

2. A system according to claim 1, wherein the subsea installed device is a valve having a valve shaft, and the apparatus is a torque tool for operating the valve.

3. A system according to claim 2, wherein the data storage capsule is mounted at the side of the valve shaft, and the read/write head is mounted at the side of the torque tool.

4. A system according to claim 3, wherein the data storage capsule is mounted on an adaptor collar attached to the valve installation.

5. A system according to claim 2, wherein the valve includes a valve stem adaptor for interfacing between the profile of the valve shaft and the profile of the tool.

6. A system according to claim 5, wherein the data storage capsule is mounted on the valve stem adaptor.

7. A system according to claim 6, wherein the read/write head is mounted within the driving head of the torque tool.

8. A system according to claim 1, wherein the installed device is at a location for: a hydraulic and electrical "hot stab", an umbilical stab-plate, an ROV docking point, a tooling interface, a lifting point, a guidepost, a choke override interface, or a subsea control module.

9. A system according to claim 1, wherein the data storage capsule and the read/write head communicate by inductive coupling.

10. A system according to claim 9, wherein the data storage capsule receives power by means of the inductive coupling.

11. A system according to claim 1, wherein the apparatus is mounted to a remotely operated vehicle which also includes a data transmission system and a power supply.

12. A system according to claim 1, wherein the apparatus is within a diver-operated tool, the tool also including a power supply and data storage means.

* * * * *